US005487529A

United States Patent [19]

Newville

[11] Patent Number: 5,487,529

[45] Date of Patent: Jan. 30, 1996

[54] FLOW-THROUGH WASHING AND SCRUBBING BRUSH HANDLE

[76] Inventor: Duane H. Newville, 6242 3rd Ave. S., St. Petersburg, Fla. 33707

[21] Appl. No.: 271,599

[22] Filed: Jul. 7, 1994

Related U.S. Application Data

[63] Continuation-in-part of Ser. No. 2,652, Jan. 11, 1993, Pat. No. 5,336,012.

[51] Int. Cl.[6] ..... A46B 11/06; A47L 13/22; F16K 51/00

[52] U.S. Cl. ..... 251/148; 401/289; 401/281; 401/203; 239/281; 403/109

[58] Field of Search ..... 251/148, 150, 251/152; 401/289, 281, 203, 275, 280, 272, 204; 239/281, 203; 16/115; 403/109, 83; 285/302

[56] References Cited

U.S. PATENT DOCUMENTS

| | | | |
|---|---|---|---|
| 4,329,076 | 5/1982 | Coreth | 403/109 |
| 4,561,798 | 12/1985 | Elcrin et al. | 403/109 |
| 5,058,619 | 10/1991 | Zheng | 251/148 X |
| 5,316,264 | 5/1994 | Newman . | |
| 5,417,511 | 5/1995 | Warden | 403/109 |

*Primary Examiner*—Martin P. Schwadron

*Assistant Examiner*—Kevin L. Lee

*Attorney, Agent, or Firm*—Joseph C. Mason, Jr.; Ronald E. Smith

[57] ABSTRACT

An improved flow-through washing and scrubbing brush handle for interconnection at one end to a source of pressurized water such as a garden hose and connectable at the other end to a flow-through type scrub brush or the like. The device includes structure for varying water flow therethrough for delivery into the scrub brush and further includes a telescoping structure which releasably secures a selected overall length between its sliding inner and outer tubes. Unique sealing arrangements also prevent water leakage anywhere along the device, including from between inner and outer tubes. A loosely fitting locking collar has a recess formed in it so that it includes a pair of circumferentially spaced apart opposed ends and a pair of stop members that are circumferentially spaced apart from one another by a greater distance than the spacing between the opposed ends. A longitudinally extending protrusion formed on an .eccentric cam surface engages a first stop member when the inner tube is rotated in a first direction relative to the outer tube. Such engagement continually pushes the locking collar around the eccentric cam surface so that the tubes freewheel with respect to one another. When the inner tube is rotated in the opposite direction, the protrusion does not engage a second stop member and the locking collar wedges between the eccentric cam surface and the outer tube to lock the inner and outer tubes relative to one another.

3 Claims, 2 Drawing Sheets

FLOW-THROUGH WASHING AND SCRUBBING BRUSH HANDLE

This is a continuation-in-part of application Ser. No. 08/002,652 filed on Jan. 11, 1993, U.S. Pat. No. 5,336,012.

BACKGROUND OF THE INVENTION

1. Field Of The Invention

This invention relates generally to cleaning and washing devices, and more particularly to a telescopic flow-through washing and scrubbing brush handle.

2. Description of the Prior Art

The use of flow-through handles or wands for washing and scrubbing automobiles, campers and other vehicles, boats, aluminum siding and windows and the like is well known. Typically, these devices include a coupling or connector at one end which is connectable to a source of pressurized water such as a garden hose and connectable at the other end thereof to a flow-through type scrubbing brush which will transfer water through the brush structure and bristles onto the surface to be cleaned. The benefits of water being continuously applied at the cleaning surface so as to both accelerate the cleaning process and rinse debris away as well as to reduce the abrasion to that working surface is also well known.

Beyond the basic concept of this above prior art device are imposed many desirable design features, some of which have not been met in prior art. One such feature is a telescoping handle wherein the overall length thereof may be adjusted and secured at any desired length. Conventional rotationally actuated cam locking arrangements for this purpose are well known.

Another desirable design feature is the ability to vary the water flow though the device, including the ability to quickly interrupt water flow to prevent water waste. Here again various shut-off devices for garden hose arrangements are also well known.

Perhaps the most annoying feature of the present prior art devices is the water leakage which occurs during use both at the garden hose coupling end of the device and at the mid portion thereof where the outer tube overlaps the inner tube to facilitate the telescoping feature. Although the user may anticipate some water contact during a car washing procedure, nonetheless the presently existing degree of water leakage through present devices is so excessive as to impose a serious limitation on the overall usefulness of these devices.

A device is needed that provides a flow-through washing and scrubbing handle which affords all of the above design features while eliminating virtually all water leakage along the entire length of the device so that all pressurized water which exits the garden hose into the device is transmitted into and through the flow-through brush head itself without leakage.

SUMMARY OF THE INVENTION

The invention is directed to an improved flow-through washing and scrubbing brush handle for interconnection at one end to a source of pressurized water such as a garden hose and connectable at the other end to a flow-through type scrub brush or the like. The device may include structure for varying water flow therethrough for delivery into the scrub brush and further includes a telescoping structure which releasably secures a selected overall length between its sliding inner and outer tubes.

Unique sealing arrangements also prevent water leakage anywhere along the device, including from between inner and outer tubes.

It is therefore an object of this invention to provide a telescopic flow-through washing and scrubbing brush handle for delivering water from a pressurized water source such as a garden hose into a flow-through scrubbing brush head or the like.

It is another object of this invention to provide a leakage free telescopic flow-through washing and scrubbing brush handle.

It is yet another object of this invention to provide a leakage free telescopic flow-through washing and scrubbing brush handle which will vary or shut off the flow of water therethrough also without leakage.

In accordance with these and other objects which will become apparent hereinafter, the instant invention will now be described with reference to the accompanying drawings.

BRIEF DESCRIPTION OF THE DRAWINGS

For a fuller understanding of the nature and objects of the invention, reference should be made to the following detailed description, taken in connection with the accompanying drawings in which.

DETAILED DESCRIPTION OF THE PREFERRED EMBODIMENT

Figure 1:
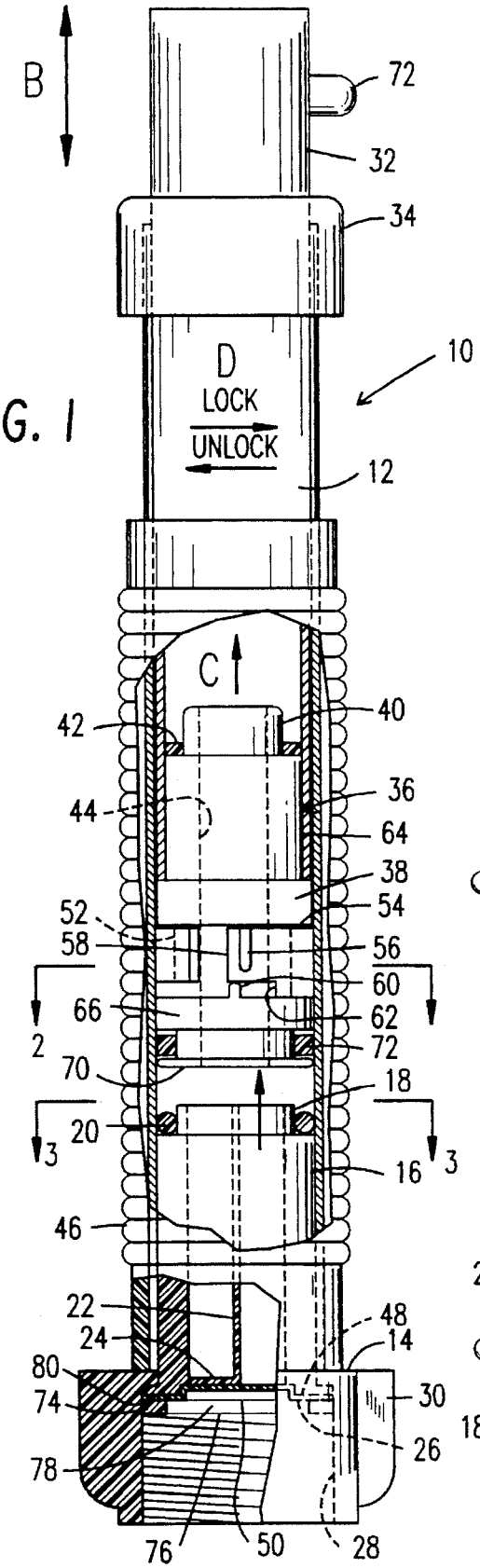
FIG. 1 is a partially broken, partially sectional, side elevational view of an illustrative embodiment of the invention.
Figure 4:
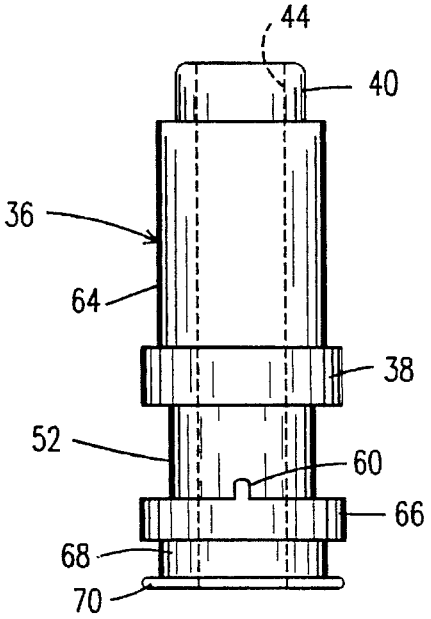
FIG. 4 is a side elevation view of the integral twist lock body shown in FIG. 1.

Referring now to the drawings, an exemplary embodiment of the invention is shown generally at numeral 10 in FIG. 1 and includes an elongated drawn aluminum outer tube 12 slidably engagable over a drawn aluminum inner tube 32. Although extruded rolled tubing stock is acceptable, it is preferred to use drawn aluminum as the dimensional tolerances are more closely held and the strength properties of the aluminum are significantly increased. The inner and outer surfaces of the inner and outer tubes 32 and 12 are also anodized for additional appearance and corrosion protection.

In a first embodiment, an end cap 34, formed of molded resilient plastic and fitted over one end of the outer tube 12, serves as a travel stop and sleeve guide to prevent the inner tube 32 from separating from the outer tube 12 and to also provide a bearing surface between the two tubes 12 and 32.

The distal end of inner tube 32 includes a depressible locking pin 72 which is engagable into a flow-through type scrubbing and cleaning brush (not shown) in a well known manner.

The lower (proximal) end of outer tube 12 includes a tubular gripping handle 46 secured therearound formed of molded resilient plastic material for convenient gripping and also includes a rotatable coupling 14. This coupling 14 includes an internal longitudinal thread 28 which is matably engagable onto the threaded end fitting of a garden hose (not shown). Coupling 14 also includes integral molded radially extending tightening flanges 30 to facilitate a more secure connection onto the end of the garden hose.

In another embodiment, end cap 34 serves as a center guide but is primarily decorative. The travel stop function is provided by a stop groove rolled into outer handle 46 which engages twist lock body 36, hereinafter disclosed, about five inches from the upper end of handle 46.

A plastic molded water control valve 16 is also fitted into the proximal end of outer tube 12; it has an enlarged lower flange 80 molded into one end so as to engage against the bottom of the internal threaded portion 28 of coupling 14. A longitudinal partition 22 is molded lengthwise through the otherwise hollow interior of control valve 16 and one half of this hollow control valve interior is closed off at its lower end by an end partition 24. This control valve 16 is rigidly secured into the end of outer tube 12 by staking or otherwise point deforming outer tube 12 to mechanically engage into control valve 16.

Rotatable flow control disc 50 is positioned against and beneath flange 80; it includes a flow aperture 48 formed therethrough. Flow aperture 48 is sized to mate and align with the open portion of control valve 16 so that water will flow upward through control valve 16 in the direction of arrow A. However, when disc 50 is rotated back and forth in the direction of arrow F so as to either partially or fully misalign with the open half of the control valve 16 so as to partially or fully align with end partition 24, the water flow in the direction of arrow A is either diminished or stopped altogether.

A conventional rubber sealing grommet 76 having central hole 78 therethrough is fitted against control disc 50 in a well-known manner. To insure that disc 50 truly follows the rotation of coupling 14, prongs 74 which are integrally molded and downwardly extending from disc 50 are provided for mechanical penetrating engagement into rubber grommet 76.

A rubber O-ring 20 is fitted around a reduced diameter end groove 18 of the control valve 16 to insure that water flowing in the direction of arrow A under pressure does not backflow between control valve 16 and outer tube 12.

A twist lock body is shown generally at 36 and structurally facilitates both the locking engagement between the inner and outer tubes 32 and 12, respectively, and also prevents any water leakage between the inner and outer tubes 32 and 12. This twist-lock body 36 is integrally molded of plastic and includes at its upper (distal) end, as depicted in FIG. 1, a reduced diameter end groove 40 sized to receive a rubber O-ring 42 for sealing engagement against the inner wall of inner tube 32. Cylindrical main body portion 64 is mechanically secured within inner tube 32 by staking as previously described.

Twist-lock body 36 also includes a longitudinal passageway 44 therethrough so that water flowing in the direction of arrow A will flow therethrough in the direction of arrow C into the interior of inner tube 32 for discharge into a conventional flow-through brush connected at the distal end of said inner tube 32 (not shown) as previously described. Shoulder 38 serves as a mechanical stop against the lower end of cap 34.

A sealing groove is formed adjacent the lower shoulder end 70 of twist-lock body 36 to receive a one-way packing seal 72 such as provided by Parker Seals of Salt Lake City, Utah, Series 8500. This seal 72 is provided to sealably prevent water flowing into the interior of outer tube 12 in the direction of arrow A from escaping or leaking therearound. Absent this seal 72, the pressurized water would leak out from between the inner and outer tubes 32 and 12, respectively.

Figure 2:
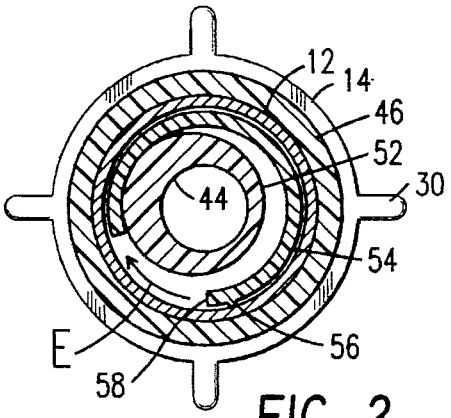
FIG. 2 is a transverse sectional view taken along lines 2—2 in FIG. 1.
Figure 3:
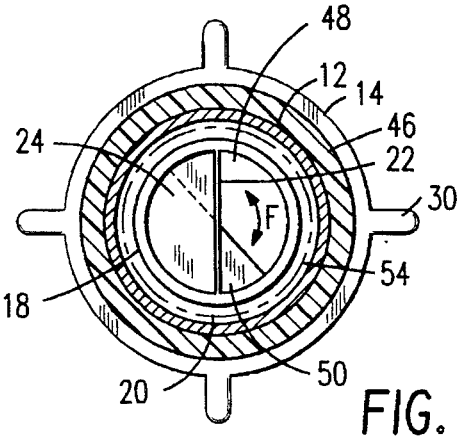
FIG. 3 is a transverse sectional view taken along lines 3—3 in FIG. 1.

The twist-lock body also includes an eccentric or off-center cam surface 52 as best seen in FIG. 2, loosely mounted around which is a resilient plastic locking collar 54 having circumferentially spaced apart opposed ends 58, 58 to facilitate installation of said locking collar and to permit compressibility of said locking collar. Locking collar 54 includes bump or protrusion 56 adjacent end surface 58 so that, when the locking collar is rotated in the direction of arrow E, a wedging effect between the interior surface of outer tube 12 and eccentric cam surface 52 is effected. By this arrangement, a secure yet releasable locking engagement is effected between the inner and the outer tube 32 and 12, respectively, at any preselected arranged telescopic length in the direction of arrow B. Stop surface 62 formed in the trailing end of locking collar 54 serves to prevent overrotation in the direction of arrow E against longitudinally-extending protrusion 60 of the twist-lock body 36. Note that the longitudinal extent of protrusion 60 is insufficient to engage opposed ends 58, 58 of locking collar 54. This enables freewheeling of said inner and outer tubes when rotated in the "UNLOCK" direction, as set forth with more particularity hereinafter.

Figure 5:
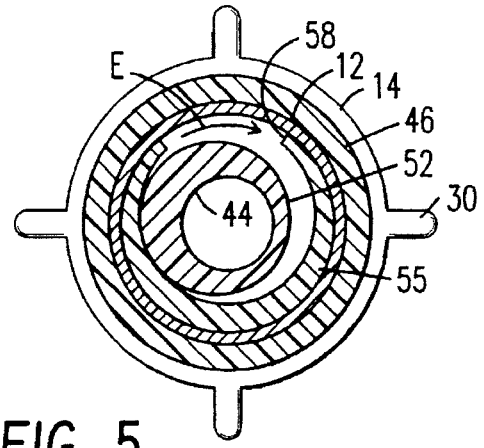
FIG. 5 is a transverse sectional view of a second embodiment of the novel locking collar.
Figure 6:
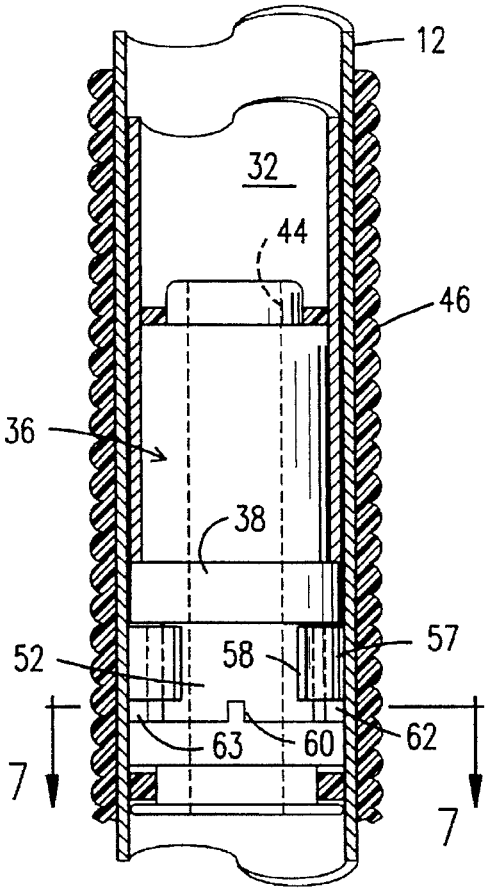
FIG. 6 is a partial longitudinal section disclosing a third embodiment of the novel locking collar.

The embodiment of FIG. 5 eliminates protrusion 56 but the above-described wedging effect is still achieved. In this embodiment, locking collar 55 replaces locking collar 54; note that locking collar 55 has a generally annular, eccentric configuration and is thin at its circumferentially spaced apart opposite ends and gradually thickens (in a radial direction) until it reaches its greatest thickness at a point diametrically opposed to a point midway between said thin opposite ends. The point of greatest thickness may be formed in said locking collar 55 at any other point between said opposing ends as well. Thus, the above-described wedging action is achieved in the absence of protrusion 56 upon rotation in the direction of arrow E, and unlocking is achieved by rotation in the opposite direction.

A third embodiment of the novel locking collar which also eliminates protrusion 56 is denoted 57 in FIGS. 6–9; note that it has an eccentric structure like locking collar 55 of FIG. 5. Note further that it has opposed ends 58, 58 like the FIG. 5 embodiment, but it also has recessed opposed stop surfaces 62, 63 like the FIG. 1 embodiment. Stop surfaces 62, 63 are formed by a circumferentially extending recess formed in the proximal edge of the locking collar. Said surfaces 62, 63 are circumferentially spaced further apart than opposed ends 58, 58. As mentioned earlier, the longitudinal extent of protrusion 60 is sufficient to abuttingly engage stop surfaces 62, 63, but not opposed ends 58, 58.

Figure 7:
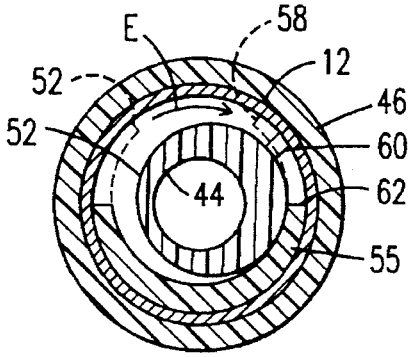
FIG. 7 is a transverse sectional view taken along line 7—7 in FIG. 6.

In FIG. 7, outer tube 12 has been rotated in direction E, and the bulged part of eccentric cam surface 52 has wedged against locking collar 57 (as depicted at about the three o'clock position in FIG. 7), thereby preventing further relative rotation in direction E of outer tube 12 with respect to inner tube 32 and thus locking said inner and outer tubes.

Figure 8:
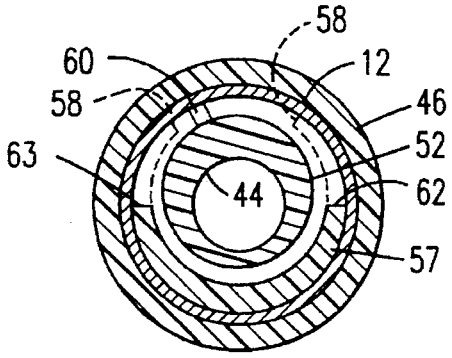
FIG. 8 is a transverse sectional view of the parts depicted in FIG. 7 when the inner and outer tubes are in an unlocked position.
Figure 9:
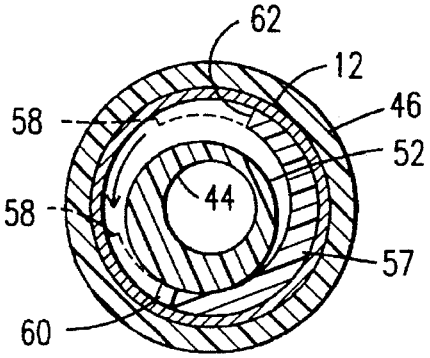
FIG. 9 is a transverse sectional view of the parts depicted in FIG. 7 when the inner and outer tubes are in a freewheeling, unlocked position.

In FIG. 8, outer tube 12 has been rotated in a direction opposite to direction E (the "UNLOCK" direction depicted in FIG. 1) and cam surface 52 is no longer wedged against locking collar 57 so that the relative telescoped position of the inner and outer tubes 32 and 12 may be changed.

If the rotation of FIG. 8 continues, protrusion 60 will rotate into abutting engagement with stop surface 63. However, the tolerances are such that when protrusion 60 abuts said stop surface 63, cam surface 52 does not wedge against said locking collar 57. Thus, protrusion 60 and cam surface 52 with which it is integrally formed, together with locking collar 57, will continually rotate in the direction of the arrow in FIG. 9, i.e., said parts will freewheel and the inner and outer tubes will not lock.

It should be observed that twist lock body 36 having eccentric cam surface 52 and any of the loosely fitting locking collars disclosed herein need not include flow through passageway 44, i.e., it has utility in various non flow through applications as well. Thus, FIGS. 2, 4, 5, and 7–9 should also be construed as not having passageway 44, i.e., twist lock body 36 may have a solid construction.

While the the instant invention has been shown and described herein in what are believed to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

Now that the invention has been described,

What is claimed is:

1. An improved flow-through washing and scrubbing brush handle, comprising:

an elongated hollow outer tube having a coupling structured for connecting a first end of said outer tube to a pressurized water supply;

an elongated rigid hollow inner tube mounted for slidable rotational and longitudinal movement within said outer tube, a first end of said inner tube extendable beyond a second end of said outer tube and connectable to a flow-through type brush head;

an elongated twist-lock body having a central longitudinal water passage therethrough, a first portion of said twist-lock body connected within a second end of said inner tube positioned within said outer tube;

said twist-lock body having a first sealing ring around the end of said first portion thereof for preventing water passing into said inner tube through said water passage from passing out of said inner tube second end;

a second sealing ring positioned transversely around an end of a second portion of said twist-lock body extending into said outer tube beyond said inner tube second end, said second sealing ring structured for preventing pressurized water entering said outer tube first end from passing between said inner and outer tubes;

said twist lock body second portion having an eccentric cam segment;

a locking collar loosely positioned transversely around said eccentric cam segment;

said locking collar having a generally C-shaped, eccentric construction that includes a pair of circumferentially spaced opposing ends having a first predetermined thickness, and wherein said locking collar gradually thickens, in a radial direction, until it reaches a second predetermined thickness at a preselected point between said opposing ends, said second predetermined thickness being greater than said first predetermined thickness;

a longitudinally extending protrusion formed on said eccentric cam segment;

said locking collar having a circumferentially extending recess formed therein, said recess forming a pair of stop surfaces that are circumferentially spaced further apart from one another than said opposing ends of said locking collar;

said locking collar being wedged against said outer tube when said outer tube is rotated in a first direction;

said locking collar being continuously rotatable with respect to said outer tube when said outer tube is rotated in a second direction opposite to said first direction; and a stop surface of said locking collar abutting said longitudinally extending protrusion when said outer tube is rotated in said second direction;

said inner and outer tubes locking together when relatively rotated in said first direction and freewheeling in an unlocked configuration when said inner and outer tubes are rotated with respect to one another in said direction opposite to said first direction.

2. The improved flow-through washing and scrubbing brush handle as set forth in claim 1, further comprising:

means connected to said coupling and positioned within said outer tube first end for adjusting the volume and controlling the flow of water through said outer tube.

3. The improved flow-through washing and scrubbing brush handle as set forth in claim 1, wherein said locking collar is formed of resilient material.

* * * * *